US007108575B2

(12) United States Patent
Lee et al.

(10) Patent No.: US 7,108,575 B2
(45) Date of Patent: Sep. 19, 2006

(54) METHOD FOR FABRICATING MESH OF TETRAODE FIELD-EMISSION DISPLAY

(75) Inventors: Shie-Heng Lee, Taipei (TW); Kuei-Wen Cheng, Taipei (TW)

(73) Assignee: Teco Nanotech Co., Ltd., Taoyuan County (TW)

( * ) Notice: Subject to any disclaimer, the term of this patent is extended or adjusted under 35 U.S.C. 154(b) by 331 days.

(21) Appl. No.: 10/827,276

(22) Filed: Apr. 20, 2004

(65) Prior Publication Data

US 2005/0233670 A1 Oct. 20, 2005

(51) Int. Cl.
*H01J 9/02* (2006.01)

(52) U.S. Cl. ..... 445/46; 445/23

(58) Field of Classification Search ..... 445/23–25, 445/46, 49–51; 313/495–497, 309, 336, 313/351

See application file for complete search history.

(56) References Cited

U.S. PATENT DOCUMENTS 5,319,279 A * 6/1994 Watanabe et al. ..... 313/309
5,973,452 A * 10/1999 Bojkov et al. ..... 313/495

* cited by examiner

*Primary Examiner*—Joseph Williams

(57) ABSTRACT

A method for fabricating a mesh structure of a tetraode field-emission display is disclosed. The mesh has a tri-layer structure including a gate layer, an insulation layer and a converging electrode layer. The converging electrode layer is selected from a metal conductive plate with a plurality of aperture, the insulation layer is coated on the converging electrode layer, and a gate is formed on the insulation layer.

16 Claims, 5 Drawing Sheets

METHOD FOR FABRICATING MESH OF TETRAODE FIELD-EMISSION DISPLAY

BACKGROUND OF THE INVENTION

The present invention relates in general to a method for fabricating a mesh of a tetraode field-emission display, and more particular, to a method for fabricating a mesh combining a converging electrode layer, an insulation layer and a gate layer.

The field-emission display is a very newly developed technology among flat panel display field. Being self-illuminant, such type of display does not require a back light source like the liquid crystal display. In addition to the better brightness, the viewing angle is broader, power consumption is lower, response speed is faster (no residual image), and the operation temperature range is larger. The image quality of the field-emission display is similar to that of the conventional cathode ray tube (CRT) display, while the dimension of the field-emission display is much thinner and lighter compared to the cathode ray tube display. Therefore, it is foreseeable that the field-emission display may replace the liquid crystal display in the market. Further, the fast growing nanotechnology enables nano-material to be applied in the field-emission display, such that the technology of field-emission display will be commercially available.

FIG. 1 shows a conventional triode field-emission display, which includes an anode plate 10 and a cathode plate 20. A spacer 14 is placed in the vacuum region between the anode plate 10 and the cathode plate 20 to provide isolation and support thereof. The anode plate 10 includes an anode substrate 11, an anode conductive layer 12 and a phosphor layer 13. The cathode plate 20 includes a cathode substrate 21, a cathode conductive layer 22, an electron emission layer 23, a dielectric layer 24 and a gate layer 25. A potential difference is provided to the gate layer 25 to induce electron beam emission from the electron emission layer 23. The high voltage provided by the anode conductive layer 12 accelerates the electron beam with sufficient momentum to impinge the phosphors layer 13 of the anode plate 10, which is then excited to emit a light. To allow electron moving in the field-emission display, the vacuum is maintained at least under $10^{-5}$ torr, such that a proper mean free path of the electron is obtained. In addition, contamination and poison of the electron emission source and the phosphors layer have to be avoided. Further, the electron emission layer 23 and the phosphors layer 13 have to be spaced from each other by a predetermined distance for accelerating the electron with the energy required to generate light from the phosphors layer 13.

The electron beam emitted by the conventional structure is typically in a fan configuration, and the diverging range of such electron beam is difficult to control by the triode field-emission display. The electron beam is easily excessively divergent and may even impinge the phosphors layer 33 of the neighboring unit to degrade the display effect. Therefore, a tetra-polar structure is proposed as shown in FIG. 2. In the tetra-polar structure, a fourth electrode, that is, the converging electrode is formed in addition to the triode structure. A mesh 5 is formed between the cathode plate 40 and the anode plate 30. The mesh 5 includes a converging electrode layer 51, an insulation layer 52 and a gate layer 53. The converging electrode layer 51 is proximal to the anode plate 30, the gate layer 53 is proximal to the cathode plate 40, and the insulation layer 52 is sandwiched between the converging electrode layer 51 and the gate layer 53. An isolation wall 44 is formed to extend between the gate layer 53 and the cathode layer 40. The cathode plate 40 includes a cathode substrate 41, a cathode conductive layer 42 and an electron emission source layer 43. The gate layer 53 and the converging electrode layer 51 carries adequate potentials. A plurality of apertures 54 is formed to extend through the mesh 5. Each of the apertures 54 is aligned with a corresponding unit of anode and cathode, such that electron beam generated from the electron emission source layer 43 can propagate towards the phosphor layer 33.

Practically, due to the divergence of the electron beam, the apertures 54 of the mesh 5 are modified as shown in FIG. 3. That is, the first aperture 511' of the converging electrode layer 51' is larger than the second aperture 521' of the insulation layer 52' and the third aperture 531 ' of the gate layer 53'. In fabrication, a metal conductive plate is used as a base of the mesh 5. That is, the converging electrode layer 51 fabricated from the metal conductive plate. The insulation layer 52 is formed on the bottom surface of the metal conductive layer. A conductive layer is then formed on the bottom surface of the insulation layer 52 to serve as the gate layer 53. The metal conductive plate is processed to form an array of first through apertures 511'. The position of each first aperture 511 ' is aligned with each unit of anode and cathode formed on the anode and cathode plates 30 and 40, respectively. The apertures 54 serve as emission channel for the electron beam emitted from each cathode.

The above tetraode structure provides the converging electrode layer 51 to converge the electron beam, such that the electron beam can impinge the corresponding phosphors layer 33 precisely. Therefore, the electron beam is prevented from impinging the phosphor layer 33 of the neighboring units. The display effect of the field emission display is thus greatly enhanced. However, as the insulation layer 52 and the gate layer 53 are still fabricated by screen printing, the disadvantages are existed as follows.

First, as shown in FIG. 3, since the first aperture 511' of the converging electrode layer 51' is larger, when printing the insulation layer 52' and the gate layer 53', the peripheries of the second aperture 521' and the third aperture 531' may be damaged.

Second, since the existence of the first aperture 511', when printing the insulation layer 52' and the gate layer 53', the first aperture 511 ' may be contaminated by applying a glass glue coating of the insulation layer 52', and the conduction between the gate layer 53' and the converging electrode layer 51' may be blocked by applying a silver glue coating of the gate layer 53'.

BRIEF SUMMARY OF THE INVENTION

The present invention provides a method for fabricating a mesh of a tetraode field-emission display. A tri-layer mesh including a converging electrode layer, an insulation layer and a gat layer is laminated by a pressing apparatus, and the photolithography and etching process instead of the screen printing process is performed to prevent the deterioration of the second and third apertures, and the short conduction between of the gate layer and the converging electrode layer, such that the yield of mesh production is enhanced.

The mesh structure provided by the present invention is fabricated by processing a metal conductive layer served as the converging electrode layer with a plurality of first apertures, pressing a glass glue to fill in the first apertures, forming an insulation layer, removing filled glass glue from the first aperture by etching, and forming the gate layer and a plurality of second and third apertures corresponding to the first apertures in the insulation layer and the gate layer respectively.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
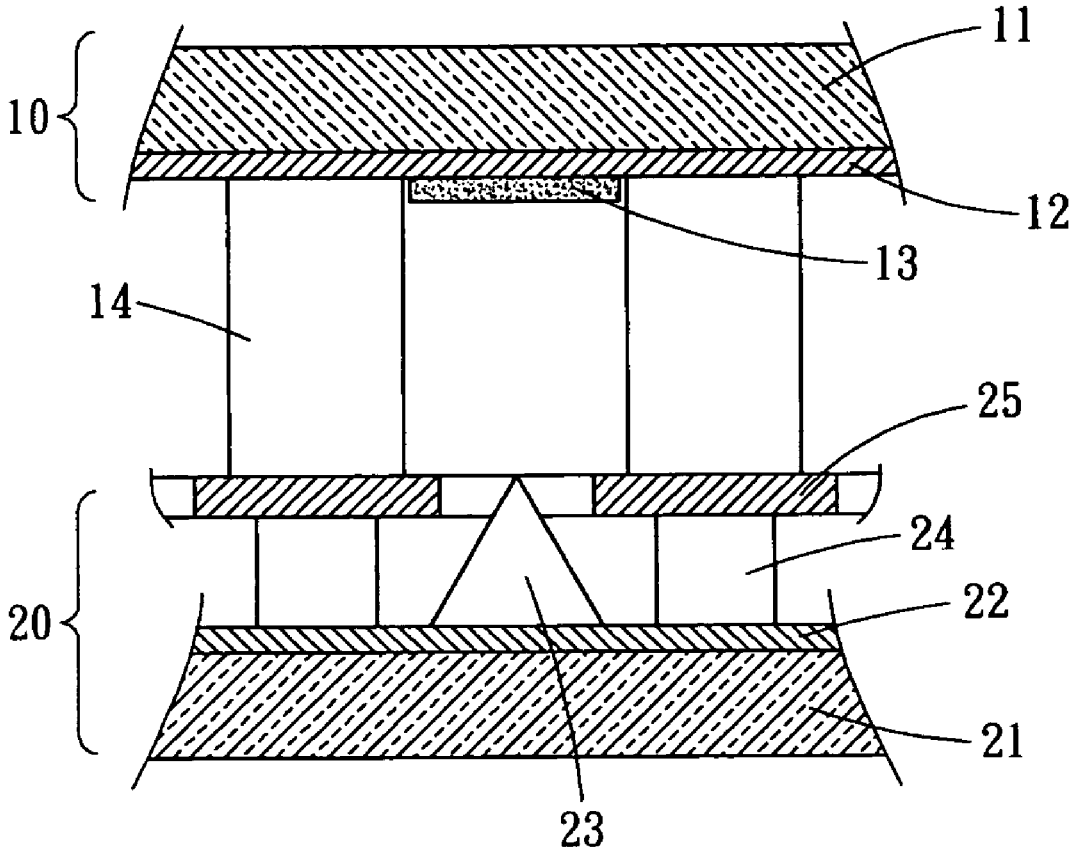
FIG. 1 PRIOR ART
FIG. 1 illustrates a local cross sectional view of a conventional triode field-emission display.
Figure 2:
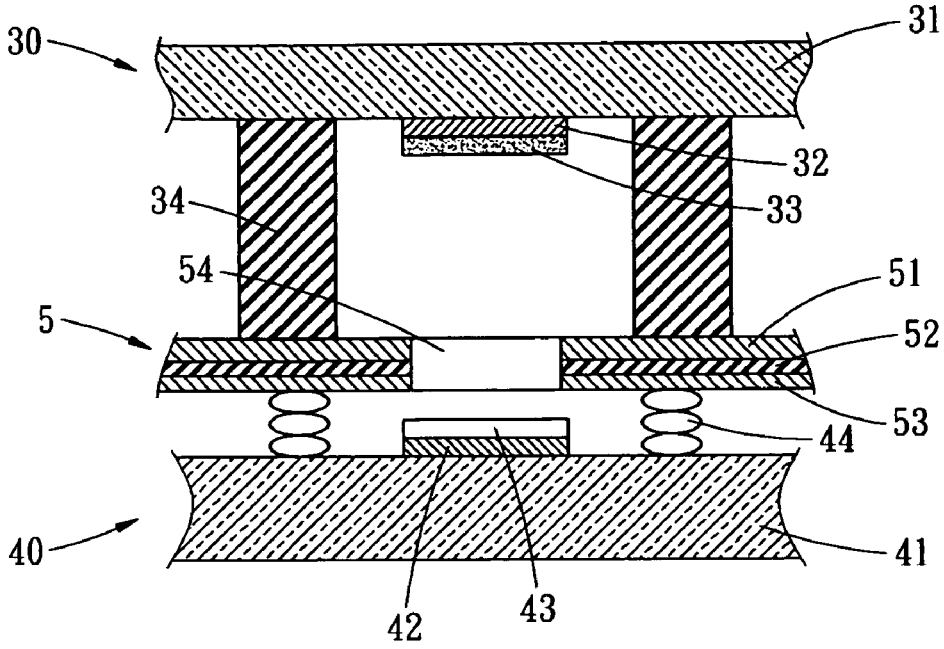
FIG. 2 PRIOR ART
FIG. 2 is a local cross sectional view of a tetraode field-emission display.
Figure 3:
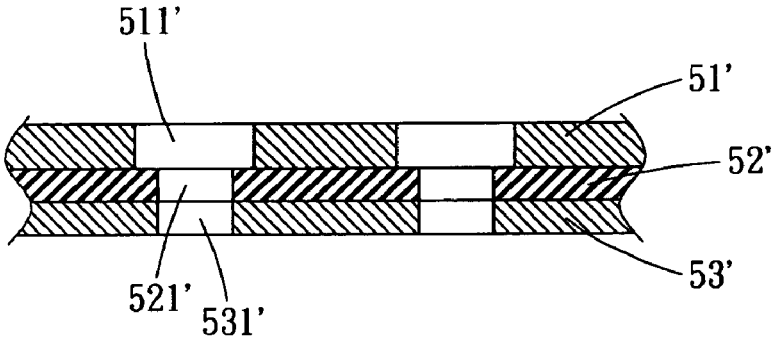
FIG. 3 PRIOR ART
FIG. 3 is a schematic drawing of a mesh of a tetraode field-emission display.

Reference will now be made in detail to the preferred embodiments of the present invention, examples of which are illustrated in the accompanying drawings. Wherever possible, the same reference numbers are used in the drawings and the description to refer to the same or like parts.

Figure 4:
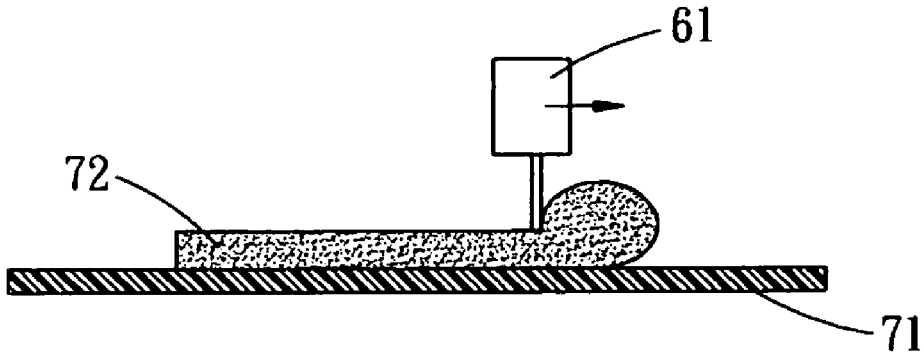
FIG. 4 shows a schematic drawing of a mesh production after the first step of the present fabrication method.

Referring to FIG. 4, according to the first step of the method for fabricating a mesh of a tetraode field-emission display of the present invention, the glass glue or the silicon oxide is used to coat on a flat film 71 by a free contact coating machine 61. Such that a coating layer 72 is formed on the film layer 71. For example, the coating layer 72 can be a glass coating paste DG001 produced by DuPond Company.

Figure 5:
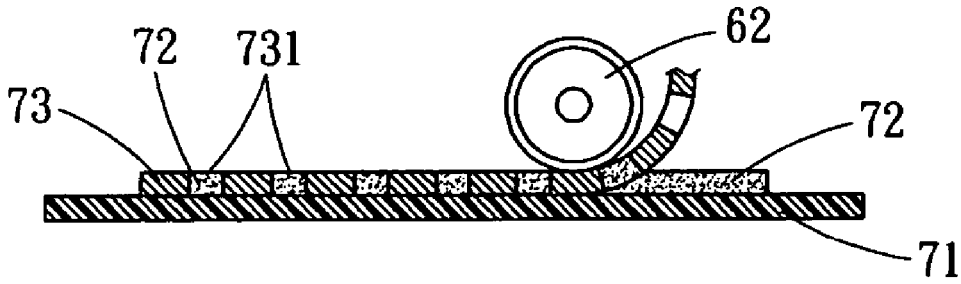
FIG. 5 shows a schematic drawing of a mesh production after the second step of the present fabrication method.

As in step two, a metal conductive plate with a plurality of first apertures 731 is formed on the coating layer 72 to serve as the converging electrode layer 73. The material of the converging electrode layer 73 is preferably selected from an iron and nickel composite plate that has a thermal expansion coefficient similar to that of the anode and cathode substrates to prevent from crack during vacuum package process due to thermal expansion difference. Thereafter, a pressing apparatus 62 is performed to laminate the coating layer 72 on the converging electrode layer 73, such that the glass glue of the coating layer 72 is filled in the first apertures 731 of the converging electrode layer 73, as shown in FIG. 5.

As in step three, after a low-temperature baking, remove the film layer 71.

Figure 6:
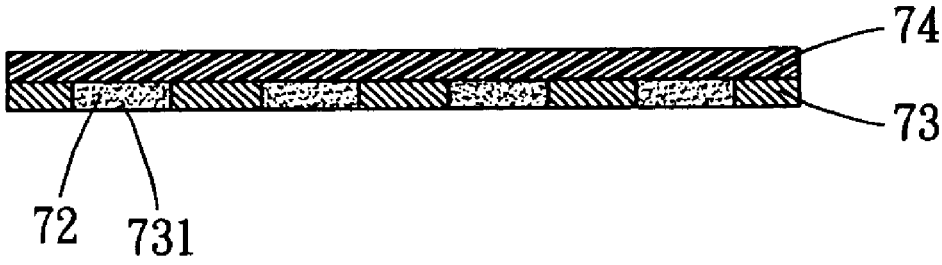
FIG. 6 is shows a schematic drawing of a mesh production after the fourth step of the present fabrication method.

In step four, a same coating as the coating layer 72 is formed by the free contact coating machine 61, or is printed by a fully printing with no pattern to form the insulation layer 74 on the converging electrode layer 73, as shown in FIG. 6. Preferably, the insulation layer 74 is formed on the same surface which the film is removed from the converging electrode layer 73.

As in step five, a sintering process is performed to harden the insulation layer 74 to firmly attach on the converging electrode layer 73.

In step six, a gate layer 75 is formed on the insulation layer 74 by the screen printing or the photolithographic process. The gate layer 75 includes a plurality of third apertures 751 corresponding to the first aperture 731 of the converging electrode layer 73. For example, the gate layer 75 can be the photosensitive silver glue such as a silver conductive paste DC206 of DuPond Company and the third apertures 751 are formed by lithography using low-concentration sodium carbonate solution as the developer.

Figure 7:
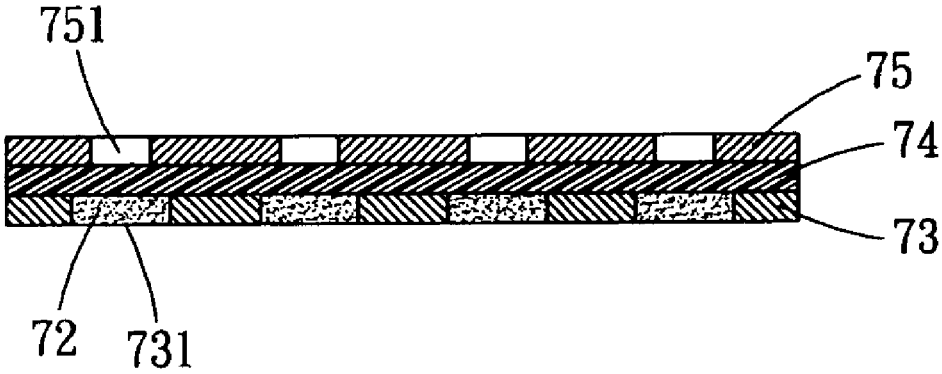
FIG. 7 shows a schematic drawing of a mesh production after the seventh step of the present fabrication method.

As in step seven, another sintering process is performed to secure the gate layer 75 attached on the insulation layer 74, as shown in FIG. 7.

Figure 8:
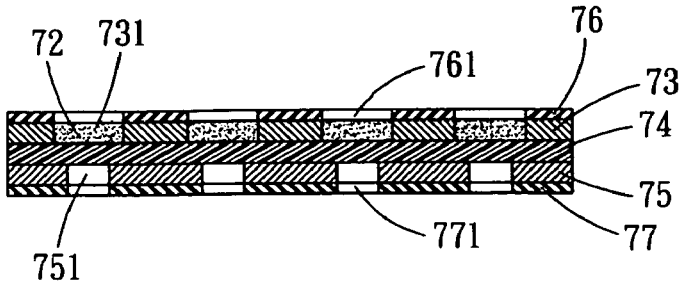
FIG. 8 shows a schematic drawing of a mesh production after the eighth step of the present fabrication method.
Figure 9:
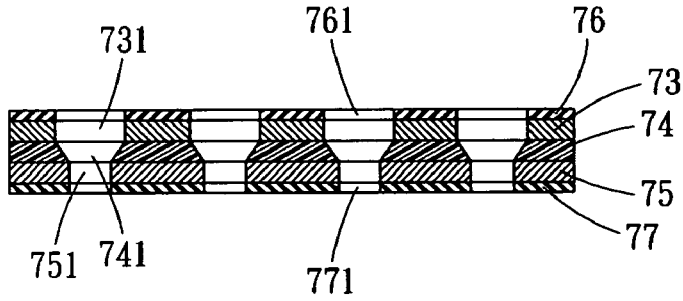
FIG. 9 shows a schematic drawing of a mesh production after the ninth step of the present fabrication method.

As in step eight, the protective layers 76 and 77 are formed on outer surfaces of the gate layer 75 and the converging layer 73, respectively. For example, a dry film with negative type photoresist can be used to form the protective layers 76 and 77, and a low-concentration sodium carbonate solution is used to develop a plurality of through hole 761 and 771 thereon, respectively, as shown in FIG. 8. The through hole 761 and 771 are corresponding to the first apertures 731 of the converging electrode layer 73 and the third apertures 751 of the gate layer 75, such that the coating material, i.e. the glass glue, filled in the first apertures 731 in the step two can be removed and a plurality of second apertures of the insulation 73 can be formed by the following etching step, respectively, As in step nine, a etching process is performed to remove the filled coating in the first apertures 731 of the converging electrode layer 73, and to form a plurality of second apertures 741 corresponding to the first apertures 731, such that the first, second, third apertures 731, 741 and 751 are aligned to form through holes, respectively, as shown in FIG. 9. For example, a low-concentration nitric acid solution is used for etching.

Figure 10:
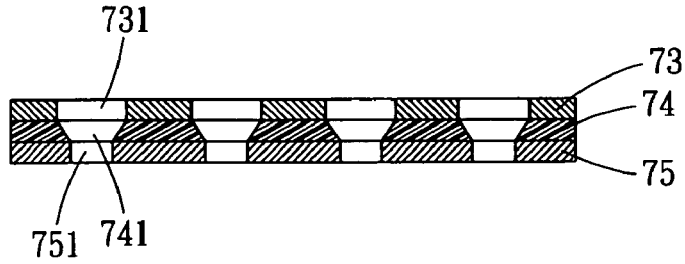
FIG. 10 shows a schematic drawing of a mesh production after the tenth step of the present fabrication method.

As in step ten, remove the protective layers 76, 77 by using a low-concentration sodium hydroxide solution to complete the mesh fabrication, as shown in FIG. 10.

Accordingly, the mesh fabricated by the present invention has the first apertures of the converging electrode layer larger than the second apertures of the insulation layer and the third apertures of the gate layer. Moreover, the above-mentioned conventional shortages are solved.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method for fabricating a mesh structure mounted between an anode plate and a cathode plate of a tetraode field-emission display, comprising:

forming a soft insulation coating layer on a flat film;

laminating a metal conductive plate as a converging electrode layer with a plurality of first apertures to the coating layer, such that a filler of the coating layer is filled in each first aperture;

removing the coating layer but remaining the filler in each first aperture after baking;

forming another coating layer on the converging electrode layer as an insulation layer;

sintering to harden the insulation layer;

forming a gate layer with a plurality of third apertures corresponding to the first apertures on the insulation layer, respectively;

sintering to have the gate layer firmly attached on the insulation layer;

forming one protective layer on the gate layer with a plurality of through holes corresponding to the third apertures, respectively, such that a plurality of second apertures are formed on the insulation layer by etching;

forming another protective layer on the converging electrode layer with another through hole corresponding to each first aperture, such that each filler is removed by etching; and removing the first and the second protective layers.

2. The method of claim 1, wherein the coating layer forming step includes forming a glass glue or a silicon oxide.

3. The method of claim 1, wherein the step of forming the coating layer on the flat film further comprises forming the coating layer by a free contact coating process.

4. The method of claim 1, wherein the coating layer forming step includes forming the coating layer with an uniform thickness.

5. The method of claim 1, wherein the converging electrode layer is selected from a metal conductive plate that has a thermal expansion coefficient similar to that of the anode and the cathode.

6. The method of claim 5, wherein the metal conductive plat is an iron and nickel composite plate.

7. The method of claim 1, wherein the laminating step further comprises performing a pressing apparatus for laminating.

8. The method of claim 1, wherein the coat layer removing step includes performing a low-temperature baking.

9. The method of claim 1, wherein the step of forming the coating layer on the converging electrode layer further comprises forming the coating layer by a free contact coating process or a fully printing process with no pattern.

10. The method of claim 1, wherein the gate layer forming step further comprises forming the gate layer by a screen printing or a photolithographic process.

11. The method of claim 1, wherein the gate layer forming step includes forming a photosensitive silver glue.

12. The method of claim 11, wherein the gate layer forming step further comprises performing a lithographic process to form the third apertures by using low-concentration sodium carbonate solution as the developer.

13. The method of claim 1, wherein the protective layer forming step further comprises forming the protective layer by a screen printing or a photolithographic process.

14. The method of claim 1, wherein the protective layer forming step includes forming a dry film with negative type photoresist, and a low-concentration sodium carbonate solution is used to develop the through holes.

15. The method of claim 1, wherein the etching is performed by a low-concentration nitric acid solution.

16. The method of claim 1, wherein protective layer removing step includes removing the first and the second protective layer by a low-concentration sodium hydroxide solution.

* * * * *